US011668194B2

(12) United States Patent
Naismith

(10) Patent No.: US 11,668,194 B2
(45) Date of Patent: Jun. 6, 2023

(54) ROTOR SHAFT CAP AND METHOD OF MANUFACTURING A ROTOR SHAFT ASSEMBLY

(71) Applicant: Siemens Energy Global GmbH & Co. KG, Munich (DE)

(72) Inventor: Martin Naismith, Glasgow (GB)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 166 days.

(21) Appl. No.: 17/044,813

(22) PCT Filed: Mar. 14, 2019

(86) PCT No.: PCT/EP2019/056383

§ 371 (c)(1),
(2) Date: Oct. 1, 2020

(87) PCT Pub. No.: WO2019/201519

PCT Pub. Date: Oct. 24, 2019

(65) Prior Publication Data

US 2021/0189881 A1 Jun. 24, 2021

(30) Foreign Application Priority Data

Apr. 17, 2018 (EP) ..... 18167822

(51) Int. Cl.
*F01D 5/02* (2006.01)

(52) U.S. Cl.
CPC ..... *F01D 5/026* (2013.01); *F01D 5/027* (2013.01); *F05D 2230/60* (2013.01);
(Continued)

(58) Field of Classification Search
CPC . F01D 5/02; F01D 5/026; F01D 5/027; F02C 7/36; F05D 2240/60; F16D 1/033; Y10T 403/7045
See application file for complete search history.

(56) References Cited

U.S. PATENT DOCUMENTS 1,610,758 A * 12/1926 Downer ..... F16D 1/033 464/170
1,641,740 A * 9/1927 Dahlstrand ..... F16D 1/033 464/154

(Continued)

FOREIGN PATENT DOCUMENTS

| | | |
|---|---|---|
| EP | 1380722 A1 | 1/2004 |
| EP | 3266981 A1 | 1/2018 |
| RU | 2328610 C2 | 7/2008 |

OTHER PUBLICATIONS

PCT International Search Report and Written Opinion of International Searching Authority dated Jun. 17, 2019 corresponding to PCT International Application No. PCT/EP2019/056383 filed Mar. 14, 2019.

*Primary Examiner* — Topaz L. Elliott
*Assistant Examiner* — Cameron A Corday

(57) ABSTRACT

A rotor shaft cap for a gas turbine has a disk-shaped body defining a first axial face, a second axial face, and an outer radial face. The disk-shaped body has a first annular jaw provided on the first axial face. The first annular jaw includes a plurality of teeth projecting from the first axial face. A plurality of apertures are defined by the disk-shaped body, each aperture of the plurality of apertures extends through the disk-shaped body along an axial direction.

14 Claims, 8 Drawing Sheets

(52) U.S. Cl.
CPC ..... *F05D 2240/24* (2013.01); *F05D 2240/60* (2013.01); *F05D 2260/964* (2013.01)

(56) References Cited

U.S. PATENT DOCUMENTS

| | | | | | |
|---|---|---|---|---|---|
| 2,523,928 | A * | 9/1950 | Szekely | F16D 1/033 | 285/410 |
| 4,123,199 | A * | 10/1978 | Shimizu | F01D 5/066 | 416/198 A |
| 2004/0020216 | A1 | 2/2004 | Wagner | | |
| 2006/0008352 | A1* | 1/2006 | Segletes | B23K 9/18 | 416/244 R |
| 2016/0168996 | A1 | 6/2016 | Mariano et al. | | |
| 2016/0298456 | A1 | 10/2016 | Winkler | | |
| 2017/0108561 | A1* | 4/2017 | Osen | F01D 25/16 | |
| 2018/0117964 | A1* | 5/2018 | Fuchs | F16D 1/033 | |

* cited by examiner

ROTOR SHAFT CAP AND METHOD OF MANUFACTURING A ROTOR SHAFT ASSEMBLY

CROSS REFERENCE TO RELATED APPLICATIONS

This application is the US National Stage of International Application No. PCT/EP2019/056383 filed 14 Mar. 2019, and claims the benefit thereof. The International Application claims the benefit of European Application No. EP18167822 filed 17 Apr. 2018. All of the applications are incorporated by reference herein in their entirety.

FIELD OF INVENTION

The present disclosure relates to a gas turbine.

In particular the disclosure is concerned with a component for a gas turbine and a method of manufacturing thereof.

BACKGROUND

Gas turbine engines, which are a specific example of turbomachines, generally include a rotor with a number of rows of rotating rotor blades which are fixed to a rotor shaft and rows of stationary vanes between the rows of rotor blades which are fixed to the casing of the gas turbine.

When a hot and pressurized working fluid flows through the rows of vanes and blades in the main passage of a gas turbine, it transfers momentum to the rotor blades and thus imparts a rotary motion to the rotor shaft. Satisfactory operation of the turbine requires accurate balancing of the rotor. The rotor shaft is therefore machined to a high degree of precision. FIGS. 1 and 2 show an exemplary gas turbine 60 including a known rotor shaft 72.

In order to provide useable work to another component of the gas turbine, such as a compressor, the rotary motion of the rotor shaft is mechanically coupled to the other component by means of a torque drive coupling. FIG. 2 shows that the known rotor shaft 72 comprises an axial end 73 into which an annular jaw 77 of curvic teeth is machined. The annular jaw 77, in use, engages and meshes with a complementary annular jaw on another component of the gas turbine to effect a known example of a torque drive coupling.

Conventionally, curvic teeth are machined into a rotor shaft towards the end of the overall manufacturing process of the rotor shaft. By this time the rotor shaft has already undergone numerous earlier manufacturing stages, giving the rotor shaft its general final shape. The physical dimensions of the rotor shaft, however, may make it difficult to machine the curvic teeth at the desired accuracy. Furthermore, any mistake when machining the curvic teeth may be irrecoverable so that expended work and cost is lost.

EP 3 266 981 A1 discloses a rotor disc assembly includes a rotor disc and a minidisc. The rotor disc has a first extension member, a first finger, and a second finger. The first extension member axially extends from a disc body disposed about an axis. The first finger extends axially from the first extension member. The second finger is circumferentially spaced apart from the first finger. The second finger extends axially from the first extension member. Each of the first finger and the second finger has a first portion and a second portion that extends radially from a distal end of the first portion. The minidisc is operatively connected to the rotor disc. The minidisc has an interlocking finger that radially extends from a minidisc body and is disposed between the first finger and the second finger. The interlocking finger, the first portion, and second portion define a ring groove.

US 2016/168996 A1 discloses a system for balancing a turbine disk stack, including a high pressure turbine disk stack. A flange is grooved to accommodate and orient a slip ring. Balancing weights are attached to the slip ring to balance the turbine disk stack during rotation of a gas turbine engine.

EP 1 380 722 A1 discloses gas turbine engine flanged shaft provided with a plurality of anti-score plates each of which has two openings which are aligned with corresponding apertures on the flange. Bolts pass through the openings and apertures to attach the anti-score plates to the flange. The anti-score plates have different masses to facilitate shaft balancing.

US 2016/298456 A1 discloses a method for joining at least two rotor elements of at least one rotor of a turbomachine. The detecting of a radial runout of at least one radially outer-lying cylindrical surface of the rotor elements at each of at least two points that are spaced axially apart from each other occurs by a measuring device. Depending on this, a relative mounting alignment of the rotor elements with respect to one another, at which the distance of the total center of mass of the rotor is minimized relative to its total axis of rotation, is determined. The invention detects of the radial runout of the radially outer-lying cylindrical surfaces of the rotor elements occurs optically by at least one optical sensor element of the measuring device.

Hence a component for a turbomachine providing reduced cost and improved balancing is highly desirable.

SUMMARY

According to the present disclosure there is provided a component for a gas turbine and a method as set forth in the appended claims. Other features of the invention will be apparent from the dependent claims, and the description which follows.

Accordingly there may be provided a rotor shaft cap for a gas turbine, comprising: a disk-shaped body defining: a first axial face, a second axial face, and an outer radial face, the disk-shaped body comprising: a first annular jaw provided on the first axial face, the first annular jaw comprising a plurality of teeth projecting from the first axial face; and a plurality of apertures defined by the disk-shaped body, each aperture of the plurality of apertures extending through the disk-shaped body along an axial direction. By providing a separately-formed rotor shaft cap it may be possible to machine the first annular jaw to a higher accuracy than has been possible using conventional manufacturing processes. Further, the rotor shaft cap may be more cost-effective to make and, if needed, re-make than an entire rotor shaft.

The disk-shaped body may comprise a first annular portion, and wherein the first annular jaw is provided on the first annular portion.

A first set of apertures of the plurality of apertures may be located in the first annular portion, and at least one tooth of the plurality of teeth is located between a pair of adjacent apertures of the first set of apertures. Using the described arrangement it may be possible to fit the rotor shaft cap into existing gas turbines.

The disk-shaped body may comprise a second annular portion, the second annular portion coaxial with the first annular portion and located radially inwards from the first annular portion, wherein a second set of apertures of the plurality of apertures is located on the second annular portion. By providing the second set of apertures in the second annular portion, the first annular jaw is unaffected and, thus, in use the rotational coupling is unaffected. Accordingly, the rotor shaft cap provides for rotational coupling of the same strength as a conventional rotor shaft.

The rotor shaft cap may be heat-treated. According to some examples, such heat treatment comprises Nitriding or case-hardening, and may provide for improved component life compared to a conventional rotor shaft which may be treated by localised flame-hardening.

The rotor shaft cap may be made from a high-performance alloy.

The disk-shaped body may have an axial runout or a radial runout of 25 μm or less, which may provide for improved balancing and reduced vibrations.

There may be provided a rotor shaft assembly comprising: a rotor shaft cap, and a rotor shaft for a gas turbine, the rotor shaft comprising: an axial end portion defining an annular recess; wherein the rotor shaft cap is: received into the annular recess with the first annular jaw extending away from the rotor shaft and secured to the rotor shaft by pins through at least some of the plurality of apertures.

The rotor shaft cap may be shrink-fitted into the annular recess. Shrink-fitting may provide rotational coupling between the rotor shaft cap and the rotor shaft. Moreover, shrink-fitting may prevent cap slippage would may misalign the fit between the cap and the shaft and, thus, affect runout values of the rotor shaft assembly.

There may be provided a gas turbine comprising the rotor shaft assembly, the gas turbine comprising: a mating component comprising a second annular jaw in engagement with the first annular jaw, the second annular jaw comprising a second set of teeth complementary to the first set of teeth.

The mating component and the rotor shaft cap may be made from a first material, wherein the rotor shaft is made from a second material, and the first material and the second material are different materials. Using the same material for the rotor shaft cap and the mating component may improve the coupling between the rotor shaft cap and the mating component in response to temperature changes. In particular, the rotor shaft cap and the mating component may exhibit the same thermal growth so that, in use, the coupling between the two may be unaffected by temperature.

There may be provided a method of manufacturing a rotor shaft assembly for a gas turbine, the method comprising: providing a rotor shaft cap as described earlier; measuring the axial runout and the radial runout of the rotor shaft cap; providing a rotor shaft defining an annular recess in an axial end portion of the rotor shaft; measuring the axial runout and the radial runout of the annular recess; calculating a first combined axial runout and a first combined radial runout of the rotor shaft carrying the rotor shaft cap in the annular recess in a first configuration; calculating a second combined axial runout and a second combined radial runout of the rotor shaft carrying the rotor shaft cap in the annular recess in a second configuration, wherein the first configuration differs from the second configuration in that the rotor shaft is rotated relative to the rotor shaft cap about the axial direction; fitting the rotor shaft cap to the rotor shaft in the first configuration or in the second configuration to optimise the combined axial runout and the combined radial runout of the rotor shaft assembly. By providing a separately-formed rotor shaft cap it may be possible to machine the first annular jaw to a higher accuracy than has been possible using conventional manufacturing processes. Further, the rotor shaft cap may be more cost-effective to make and, if needed, re-make than an entire rotor shaft.

The fitting of the rotor shaft cap to the rotor shaft may comprise shrink-fitting the rotor shaft cap into the annular recess by cooling the rotor shaft cap, heating the rotor shaft or a combination of both, prior to insertion of the rotor shaft cap into the annular recess. Shrink-fitting may provide rotational coupling between the rotor shaft cap and the rotor shaft. Moreover, shrink-fitting may prevent cap slippage may misalign the fit between the cap and the shaft and, thus, affect runout values of the rotor shaft assembly.

The fitting of the rotor shaft cap to the rotor shaft may comprise fastening the rotor shaft cap to the rotor shaft by fitting pins through at least some the plurality of apertures extending through the rotor shaft cap and corresponding holes defined by the rotor shaft.

The providing rotor shaft cap comprises manufacturing the rotor shaft cap by: providing a master having a third annular jaw, the third annular jaw being complementary to the first annular jaw; mounting the rotor shaft cap onto the master by bringing the first annular jaw and the third annular jaw into engagement, and machining the second axial face and the outer radial face while carrying the rotor shaft cap on the master. Using the master it may be possible to obtain radial and/or axial runout values which are below the runout values obtainable using conventional manufacturing processes.

BRIEF DESCRIPTION OF THE DRAWINGS

Examples of the present disclosure will now be described with reference to the accompanying drawings, in which.

DETAILED DESCRIPTION

The present disclosure relates to a component for use in a turbomachine, such as a gas turbine.

Figure 1:
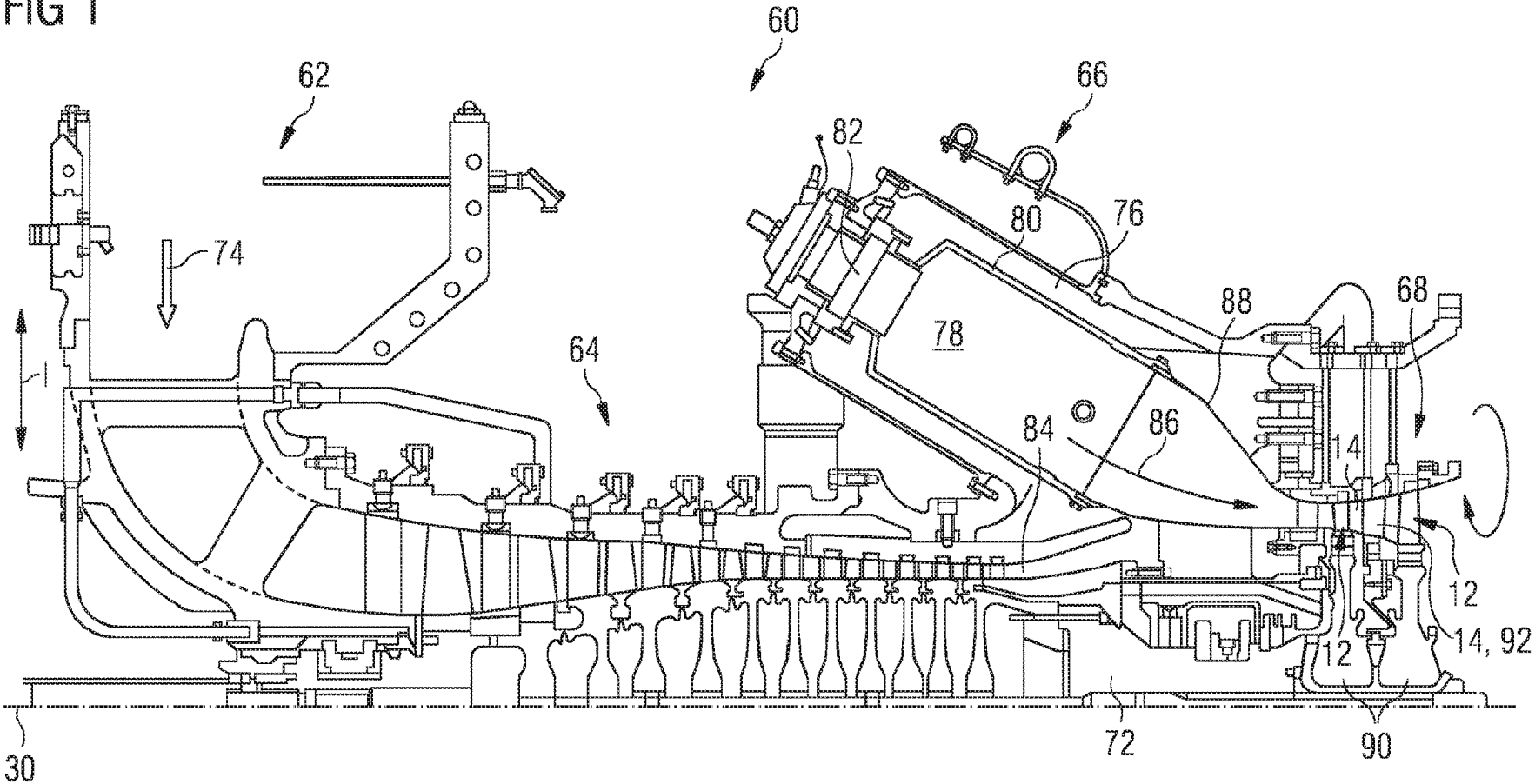
FIG. 1 is a schematic representation of an example of a turbomachine.
Figure 2:
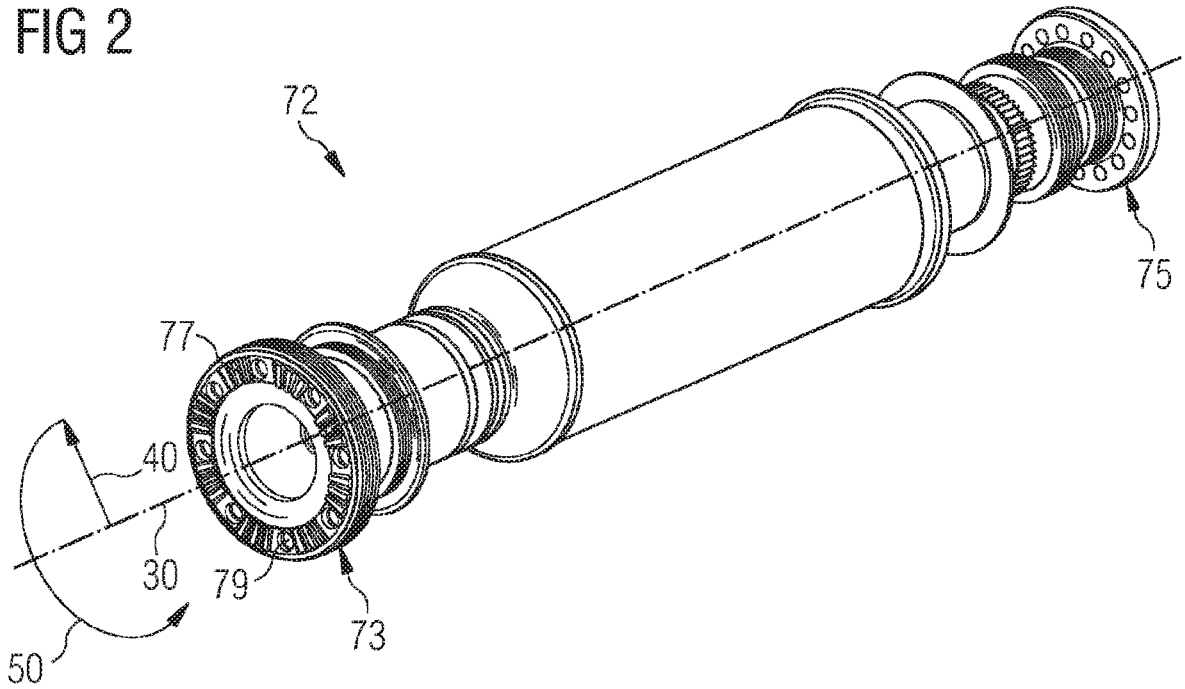
FIG. 2 is a perspective view of a known rotor shaft.

By way of context, FIGS. 1 and 2 show known arrangements to which features of the present disclosure may be applied.

FIG. 1 shows an example of a gas turbine engine 60 in a sectional view, which illustrates the nature of the stator vanes, the rotor blades and the environment in which they operate. The gas turbine engine 60 comprises, in flow series, an inlet 62, a compressor section 64, a combustion section 66 and a turbine section 68, which are generally arranged in flow series and generally in the direction of a longitudinal or rotational axis 30. The gas turbine engine 60 further comprises a shaft 72 which is rotatable about the rotational axis 30 and which extends longitudinally through the gas turbine engine 60. The rotational axis 30 is normally the rotational axis of an associated gas turbine engine. Hence any reference to "axial", "radial" and "circumferential" directions are with respect to the rotational axis 30.

The shaft 72 drivingly connects the turbine section 68 to the compressor section 64.

In operation of the gas turbine engine 60, air 74, which is taken in through the air inlet 62 is compressed by the compressor section 64 and delivered to the combustion section or burner section 66. The burner section 66 comprises a burner plenum 76, one or more combustion chambers 78 defined by a double wall can 80 and at least one burner 82 fixed to each combustion chamber 78. The combustion chambers 78 and the burners 82 are located inside the burner plenum 76. The compressed air passing through the compressor section 64 enters a diffuser 84 and is discharged from the diffuser 84 into the burner plenum 76 from where a portion of the air enters the burner 82 and is mixed with a gaseous or liquid fuel. The air/fuel mixture is then burned and the combustion gas 86 or working gas from the combustion is channelled via a transition duct 88 to the turbine section 68.

The turbine section 68 may comprise a number of blade carrying discs 90 or turbine wheels attached to the shaft 72. In the example shown, the turbine section 68 comprises two discs 90 which each carry an annular array of turbine assemblies 12, which each comprises an aerofoil 14 embodied as a turbine blade. Turbine cascades 92 are disposed between the turbine blades. Each turbine cascade 92 carries an annular array of turbine assemblies 12, which each comprises an aerofoil 14 in the form of guiding vanes, which are fixed to a stator of the gas turbine engine 60.

FIG. 2 is a perspective view of the rotor shaft 72 of the exemplary gas turbine engine 60.

The known rotor shaft 72 is a single unit having a generally cylindrical shape. The rotor shaft 72 longitudinally extends along the rotational axis 30. A pair of axial ends 73, 75 delimits (or 'bounds') the longitudinal extent of the rotor shaft 72 along the rotational axis 30. A radial surface delimits the known rotor shaft 72 with respect to the radial direction 40, which is perpendicular to the rotational axis 30 and extends outwards therefrom. The radial extent of the rotor shaft 72 thus defines an outer periphery. Also illustrated in FIG. 2 is the circumferential direction 50, which is perpendicular to both the rotational axis 30 and the radial direction 40. The circumferential direction 50 is therefore tangential to the radial surface of the rotor shaft 72.

The known rotor shaft 72 comprises a curvic coupling portion 77 extending from the axial end 73. The curvic coupling portion 77 is configured to engage a complementary curvic coupling portion on a mating component of the gas turbine engine 60, thus effecting a curvic coupling. The curvic coupling is a known means to rotationally couple the rotor shaft 72 to the mating component. Axial coupling of the rotor shaft 72 and the mating component is effected by means of a plurality of holes 79 in the axial end 73. The holes 79 are configured to make a pinned connection, for example using multibolts, to axially couple to the mating component.

Figure 3:
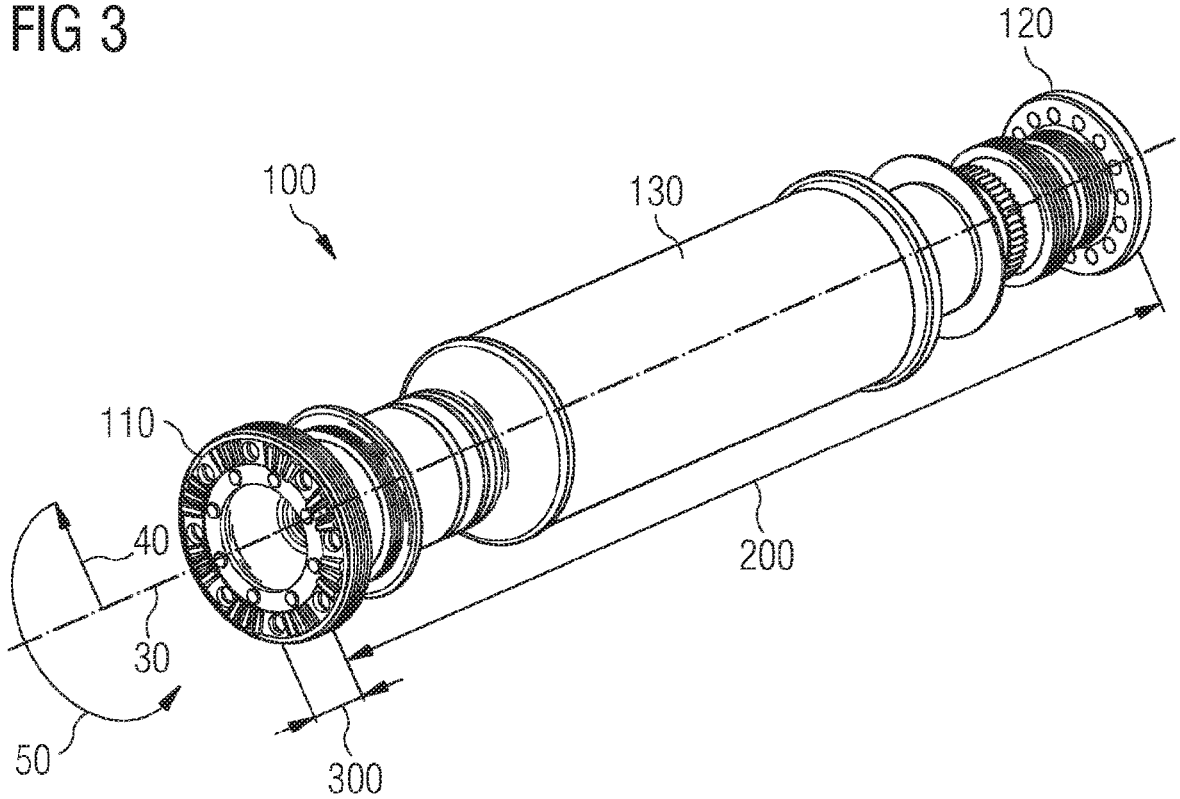
FIG. 3 is a perspective view of a rotor shaft assembly according to the present disclosure.

FIG. 3 shows a rotor shaft assembly 100 according to the present disclosure.

Some features of the rotor shaft assembly 100 are generally similar to known rotor shafts. In particular, the rotor shaft assembly 100 has an overall shape corresponding to that of known rotor shafts, such as the rotor shaft 72, so that the rotor shaft assembly 100 may replace known rotor shafts of existing gas turbine designs without requiring modification. Accordingly, the rotor shaft assembly 100 has a substantially cylindrical shape, comprising a first axial end 110, a second axial end 120 and a radial surface 130.

Unlike known rotor shafts, such as the rotor shaft 72, which are manufactured as a single unit, the rotor shaft assembly 100 comprises a plurality of individual units assembled together. In particular, the rotor shaft assembly 100 comprises a rotor shaft 200 and a rotor shaft cap 300. The rotor shaft 200 and the rotor shaft cap 300 are separate units assembled together to form the rotor shaft assembly 100. The rotor shaft 200 therefore differs from the known rotor shaft 72 in that the rotor shaft 200 is not configured to directly interface with a mating component. Instead, the rotor shaft 200 is configured to carry the rotor shaft cap 300 which is configured to directly interface with the mating component.

Figure 4:
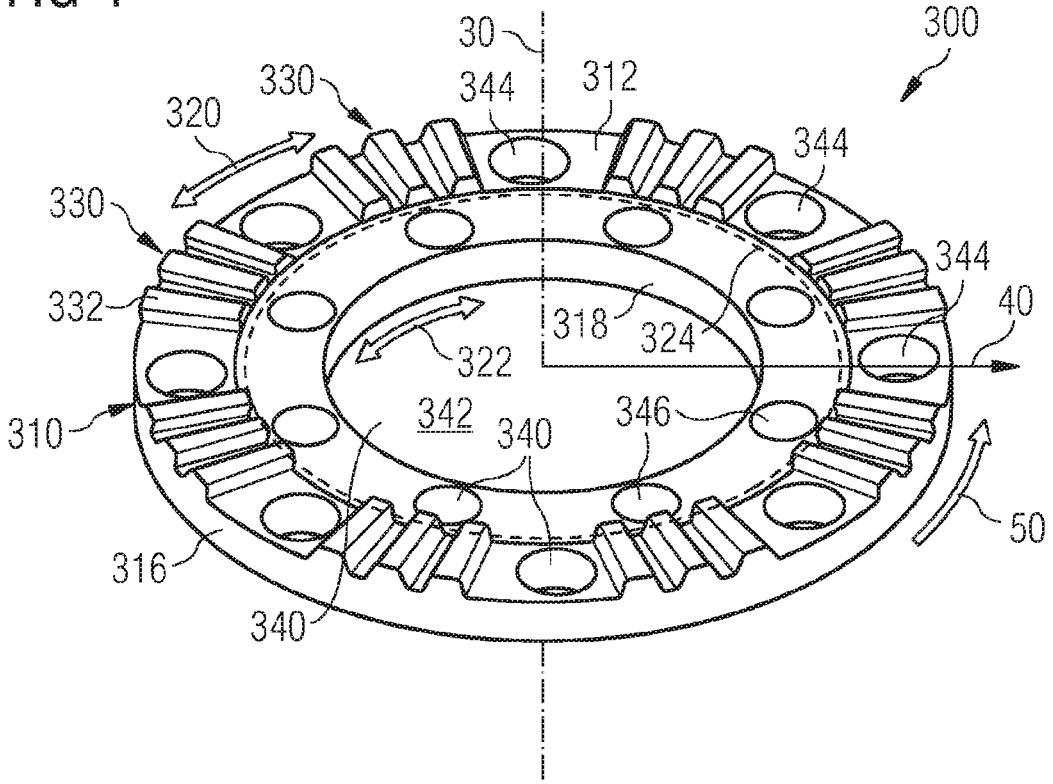
FIG. 4 is a perspective view of a rotor shaft cap according to the present disclosure.
Figure 5:
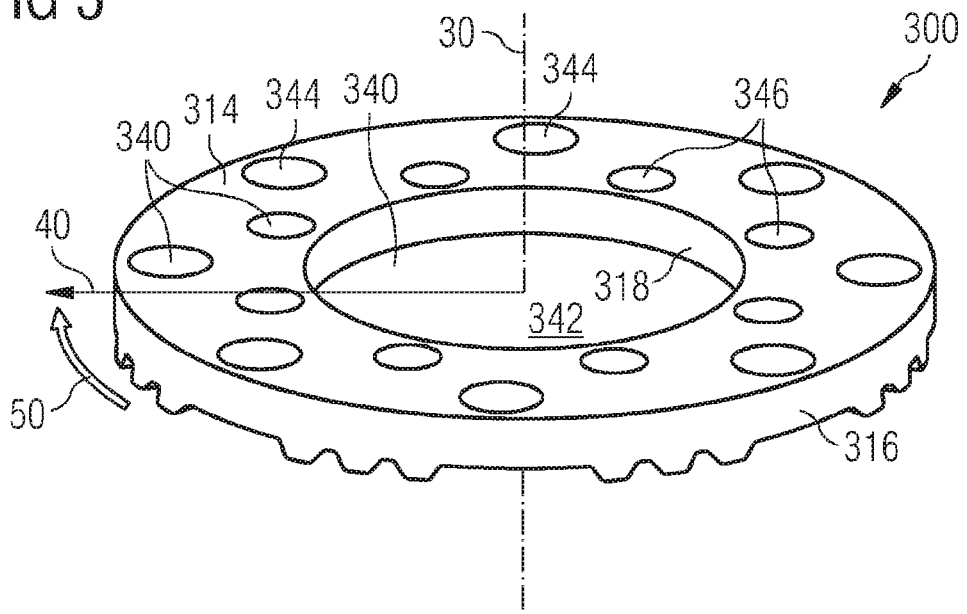
FIG. 5 is a second perspective view of the rotor shaft cap shown in FIG. 4.

FIGS. 4 and 5 show the rotor shaft cap 300. FIG. 4 is a perspective top view, while FIG. 5 is a perspective bottom view. The rotor shaft cap 300 may alternatively be referred to as a driving disk 300.

The rotor shaft cap 300 comprises a disk-shaped body 310 defining a first axial face 312, a second axial face 314 and an outer radial face 316 (or 'locating diameter').

The first axial face 312 and the second axial face 314 delimit the disk-shaped body 310 along the rotational axis 30, while the outer radial face 316 delimits the body 310 outwards in the radial direction 40. The inner radial face 318 delimits the body 310 inwardly along the radial direction 40.

The disk-shaped body 310 comprises a first annular portion 320 and a second annular portion 322. The first annular portion 320 and the second annular portion 322 are arranged coaxially, i.e. share a common axis of rotation. This shared axis of rotation corresponds to the rotational axis A:A so that each annular portion 320, 322 is coaxially arranged about the rotational axis A:A. The first annular portion 320 is provided radially outwards from the second annular portion 322. The first annular portion 320 may alternatively be referred to as an outer annular portion 320 and the second annular portion 322 may alternatively be referred to as an inner annular portion 322.

The first annular portion 320 and the second annular portion 322 are radially separated by a boundary 324 extending circumferentially around the disk-shaped body 310 along circumferential direction 50. Accordingly, the first annular portion 320 therefore radially extends between the outer radial face 316 and the boundary 324, i.e. has a radial extent bounded by the outer radial face 316 and the boundary 324. Similarly, the second annular portion 322 radially extends between the inner radial face 318 and the boundary 324, i.e. has a radial extent bounded by the inner radial face 318 and the boundary 324. According to the present example, the radial extent of the second annular portion 322 is smaller than the radial extent of the first annular portion 320.

The disk-shaped body 310 comprises a first annular jaw 330 for meshing with a complementary jaw on another gas turbine component. The first annular jaw 330 is provided on the first axial face 312.

The first annular jaw 330 comprises a plurality of teeth 332 projecting from the first axial face 312. The teeth 332 are spaced apart so that a recess 334 is defined between a pair of adjacent teeth 332. Such teeth may be curvic teeth for effecting a curvic coupling. According to the present example, each tooth 332 is concave, in the sense of having a narrow middle portion and wider ends, resulting in a convex recess 334.

According to the present example, the first annular jaw 330 is provided in the first annular portion 320. By contrast, no jaw is provided on the second axial face 314. The second axial face 314 of the disk-shaped body 310 is substantially flat.

The disk-shaped body 310 defines a plurality of apertures 340 extending therethrough. In particular, each aperture 340 extends through the body 310 along the axial direction 30, spanning the axial extent of the body 310.

The plurality of apertures 340 comprises a central aperture 342 defined by the inner radial face 318. The central aperture 342 provides for an annular disk-shaped body 310. According to the present example, the central aperture 342 is the largest aperture defined by the disk-shaped body 310. Moreover, the radial extent (or diameter) of the central aperture 342 is larger than the radial extent of the first annular portion 320 and/or the second annular portion 322.

The plurality of apertures 340 further comprises a first set of apertures 344 and a second set of apertures 346. The first set of apertures 344 is located in the first annular portion 320, while the second set of apertures 346 is located in the second annular portion 322. According to the present example, at least one tooth 332 of the plurality of teeth 332 is located between a pair of adjacent apertures 344 of the first set of apertures 344.

Each set of apertures 344, 346 is configured to receive pins for making a pinned connection with other gas turbine components. According to the present example, an aperture of the first set of apertures 344 is larger than an aperture of the second set of apertures 346.

Figure 6:
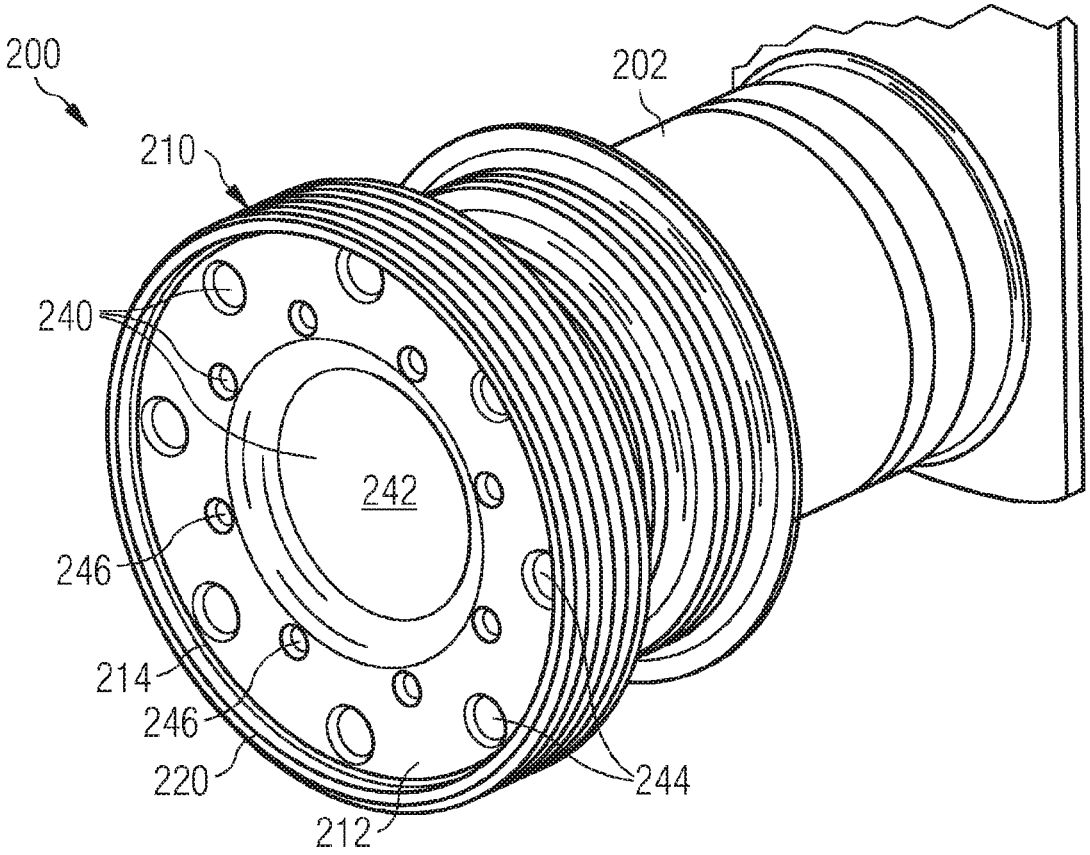
FIG. 6 is a partial perspective view of a rotor shaft according to the present disclosure.

FIG. 6 is a partial perspective view of the rotor shaft 200. The rotor shaft 200 comprises a rotor shaft bearing 202.

An axial end portion 210 of the rotor shaft 200 defines an annular recess 220 configured to receive the rotor shaft cap 300. More particularly, the axial end portion 210 comprises an annular region 212 (or 'swash face') bounding the annular recess 220 along the axial direction A:A. The annular region 212 is substantially flat. Further, the axial end portion 210 comprises an annular wall 214 (or 'concentric diameter') bounding the annular recess 220 outwards in the radial direction 40.

The axial end portion 210 defines a plurality of holes 240. Each of the plurality of holes 240 extends into the axial end portion 210 along the axial direction A:A.

The plurality of holes 240 comprises a central hole 242, a first set of holes 244 and a second set of holes 246. The first set of holes 244 is arranged annularly and regularly about the axial end portion 210. Similarly, the second set of holes 246 is arranged annularly and regularly about the axial end portion 210. The first set of holes 244 is located radially outwards from the second set of holes 246. The second set of holes is located radially outwards from the central hole 242.

Figure 7:
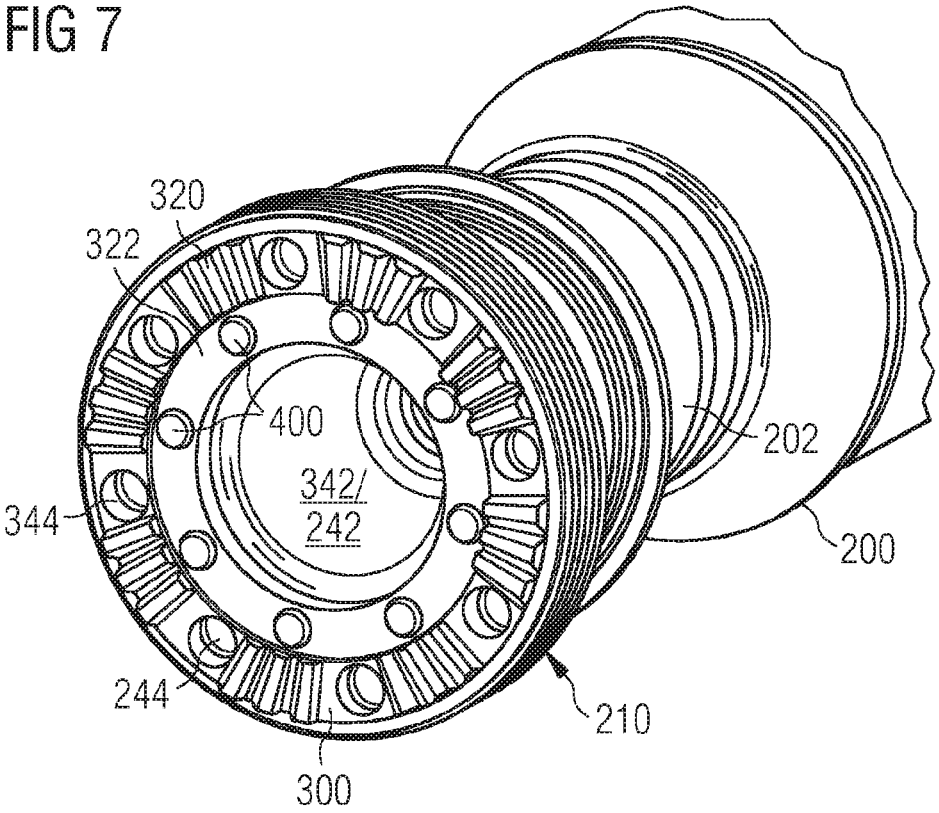
FIG. 7 shows the rotor shaft cap of FIGS. 4 and 5 and the rotor shaft of FIG. 6.
Figure 8:
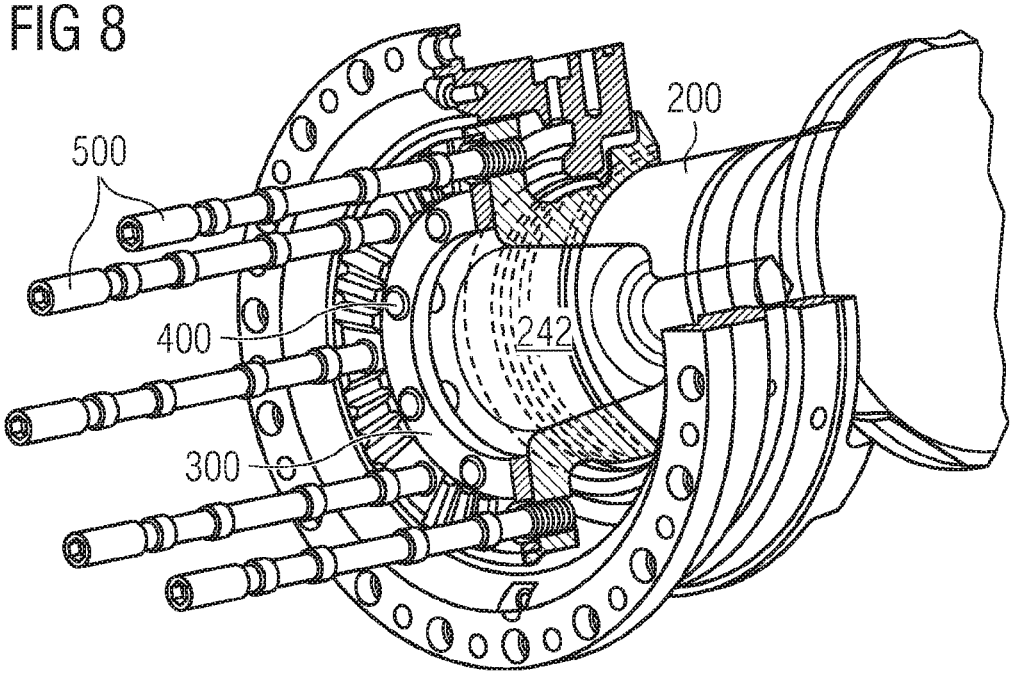
FIG. 8 shows the rotor shaft cap of FIGS. 4 and 5 and the rotor shaft of FIG. 6.

FIGS. 7 and 8 show the rotor shaft cap 300 fitted to the rotor shaft 200. As can be seen in FIGS. 7 and 8, the cap 300 possesses an axial extent which is much smaller than the axial extent of the rotor shaft 200, i.e. the body 310 is disk-shaped whereas the rotor shaft 200 is cylindrical.

The rotor shaft cap 300 is received in the annular recess 220 of the rotor shaft 200 with the first annular jaw 330 extending away from the rotor shaft 200. According to the present example, wherein the rotor shaft cap 300 is received (or 'inserted') into the rotor shaft 200, the rotor shaft cap 300 may also be referred to as a rotor shaft insert 300.

A first plurality of pins 400 is fitted through at least some of the plurality of apertures 346. More particularly, the pins 400 are fitted through the second set of apertures 346 of the rotor shaft cap 300 and the second set of holes 246 to inhibit relative rotational movement between the rotor shaft cap 300 and the rotor shaft 200. The pins 400 may alternatively be referred to as drive pins 400.

A second plurality of pins 500 is fitted through the first set of apertures 344 of the rotor shaft cap 300 and the first set of holes 244. The second plurality of pins 500 is used to axially secure a mating component to the rotor shaft assembly 100.

Figure 9:
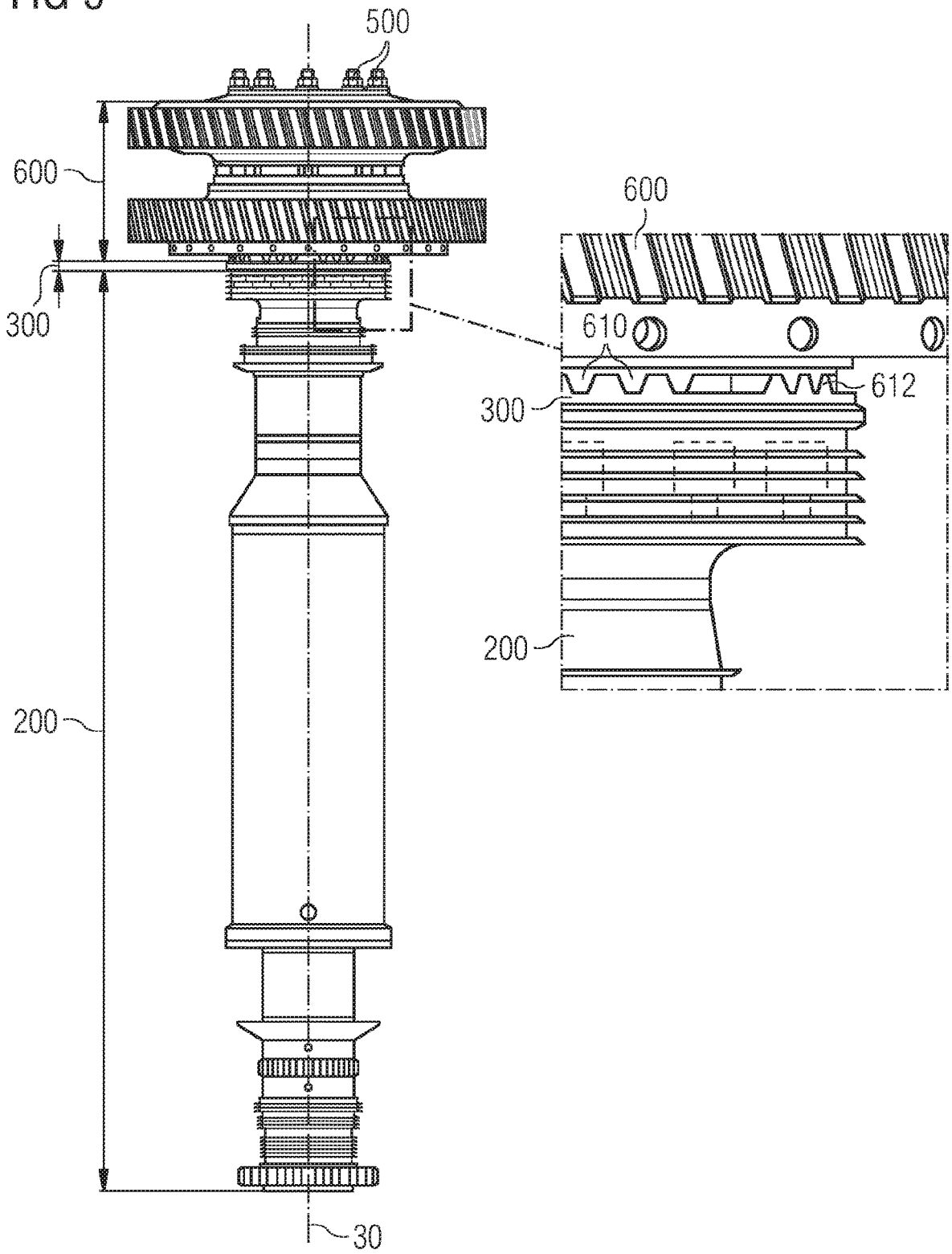
FIG. 9 is a perspective view of the rotor shaft assembly and a mating component.

FIG. 9 shows rotor shaft assembly 100 and a mating component 600.

The mating component 600, which according to the present example is a portion of a mating disk (or rotor disk), comprises a second annular jaw 610 which has been brought into engagement with the first annular jaw 330 of the rotor shaft cap 300. Accordingly, the second annular jaw 610 comprises a set of teeth 612 complementary to the first set of teeth 332.

According to the present example, the rotor shaft assembly 100 couples to the mating component 600 which is made of a high-performance alloy. The rotor shaft cap 300 is made from the same high-performance alloy, while the rotor shaft 200 is made from high-grade steel. That is to say, the mating component 600 and the rotor shaft cap 300 are made from a first material. Accordingly, the rotor shaft cap 300 and the mating component 600 possess the same material properties. By contrast, the rotor shaft 200 is made from a second material, which is different from the first material. The first material and the second material may differ, in particular, in their thermal coefficients, resulting in different material responses to temperature changes.

The present disclosure also relates to a method of manufacturing (or 'fabricating') a rotor shaft assembly 100 according to the present disclosure. An exemplary method is discussed with reference to, in particular, FIGS. 10, 11 and 12.

The rotor shaft cap 300 is manufactured from any suitable material. According to the present example, the rotor shaft cap 300 is made from a high-performance alloy, such as Inconel, which, as would be readily appreciated by a person skilled in the art, is a nickel-based superalloy.

Figure 10:
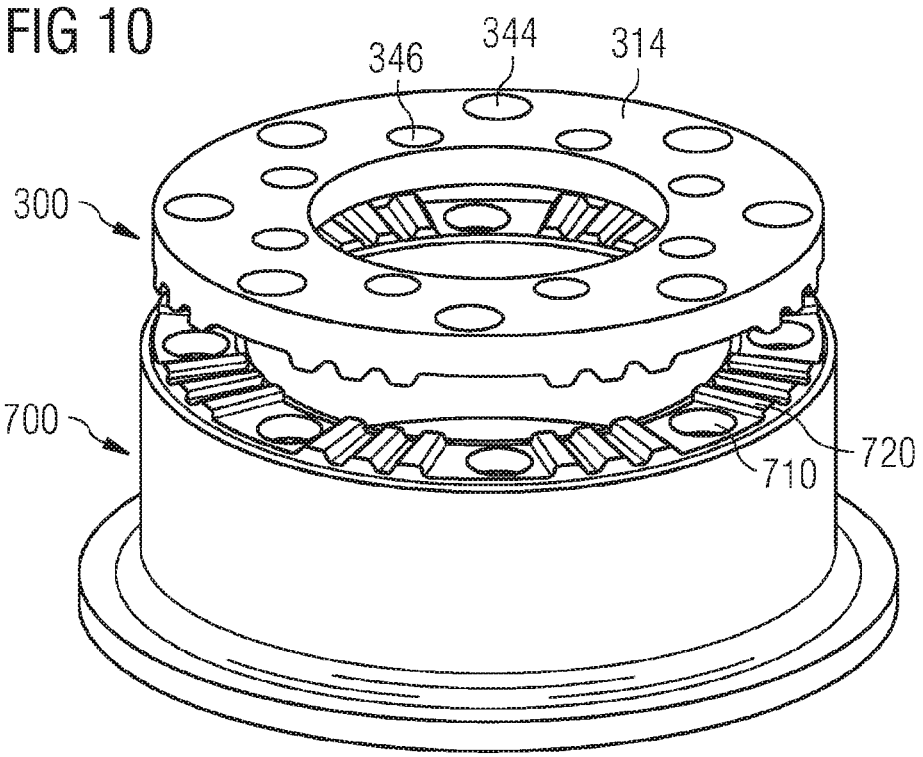
FIG. 10 is a perspective view of the rotor shaft cap and a master tool.

FIG. 10 illustrates a manufacturing step at which the rotor shaft cap 300 has attained its general shape and includes, in particular, the first annular jaw 330. That is to say, in earlier manufacturing steps the rotor shaft cap 300 has been given its general shape and the first annular jaw 330 has been machined into the rotor shaft cap 300. Subsequent to providing the rotor shaft cap 300 with the first annular jaw 330, the second axial face 314 and the outer radial face 316 are ground. For this purpose, the rotor shaft cap 300 is mounted onto a master 700.

The master 700 is a piece of tooling manufactured to a high accuracy. The master 700 comprises a third annular jaw 710, which is complementary to the first annular jaw 330 so that they may be brought into engagement, i.e. the first annular jaw 330 and the third annular jaw 710 are configured to mesh. Thus the rotor shaft cap 300 may be located relative to the master 700 to a high degree of accuracy, so that following manufacturing steps may be performed very accurately. Additionally, the rotor shaft cap 300 may be secured to the master 700 by means of pinned connections through the plurality of apertures 340, in particular the first set of apertures 344, utilising a corresponding plurality of holes 720 in the master 700.

By machining the second axial face 314 and the outer radial face 316 on the master 700 it may be possible to obtain axial runout and radial runout values of 30 μm or less. Radial runout may alternative be referred to as concentricity, and describes how much the outer radial face 316 deviates from being concentric about the rotational axis 30. A low radial runout describes a circular outer face 316 concentrically arranged about the rotational axis 30, while a high radial runout describes, for example, an egg-shaped radial face.

Axial runout may alternatively be referred to as swash. According to some examples, the axial and radial runout values are 25 μm or less. According to further examples, the axial and radial runout values are 20 μm or less. Axial runout is a measurement of how flat the second axial face 314 is as measured along the axial direction 30. That is to say, a low axial runout describes a flat second axial face 314 perpendicularly arranged with respect to the axial direction 30, whereas a high axial runout describes, for example, an axial face with hills (projections) and valleys (recesses).

Further manufacturing steps which may be performed on the rotor shaft cap 300 prior to fitting it to the rotor shaft 200 may include processes designed to ensure or increase the component life of the rotor shaft cap 300. Such processes may include, for example, Nitriding or case-hardening.

Figure 11:
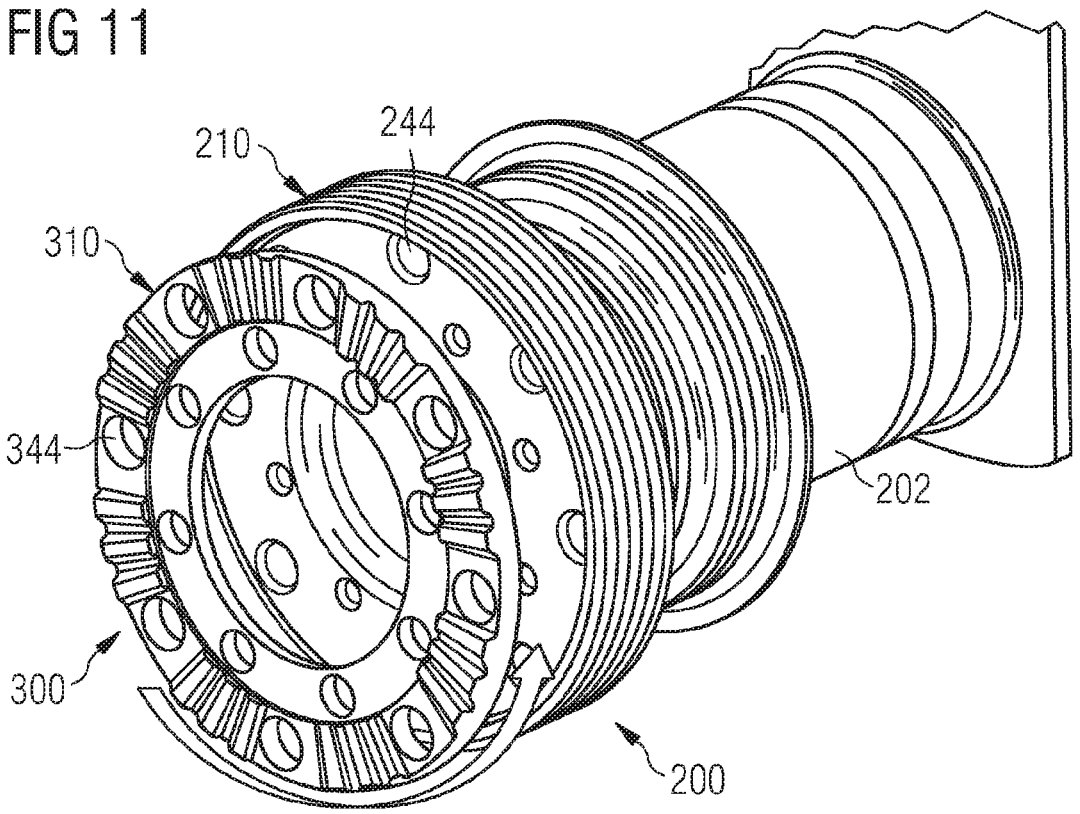
FIG. 11 shows the rotor shaft cap and the rotor shaft.

FIG. 11 illustrates fitting the rotor shaft cap 300 to the rotor shaft 200.

The exemplary manufacturing method comprises fitting the rotor shaft cap 300 to the rotor shaft 200 in an optimised configuration. This process is also referred to as 'phasing'.

The first set of apertures 344 in the rotor shaft cap 300 and the first set of holes 244 in the rotor shaft 200 allow for the rotor shaft cap 300 to be fitted to the rotor shaft 200 in as many configurations as there are holes/apertures. That is to say, the rotor shaft cap 300 may be fastened to the rotor shaft 200 so that a particular aperture is coincident with a particular hole. Similarly, the rotor shaft cap 300 may be fastened in an alternative configuration so that the particular aperture 344 is coincident with a different hole 244. According to the present example, this allows for a total of eight different configurations in which the rotor shaft cap 300 may be fitted to the rotor shaft 200. Each of these configurations may result in a different combined axial runout and/or radial runout. It is therefore considered desirable to determine a particular configuration in which the combined axial and/or radial runout is minimised.

Accordingly, the axial runout and the radial runout of the rotor shaft cap 300 are measured. In particular, the axial runout and the radial runout are measured relative to the first annular jaw 330 and recorded relative to the first set of apertures 344. Additionally, the axial runout and the radial runout of the annular recess 220 are measured. More particularly, the axial runout and the radial runout of the annular recess 220 are measured relative to the shaft bearings 202 and recorded relative to the first set of apertures 344.

Using these values it is possible to calculate the combined radial runout and the combined axial runout for the different orientations in which the rotor shaft cap 300 can be fitted to the rotor shaft 200. Suitably, the rotor shaft cap 300 is fitted to the rotor shaft 200 in a configuration in which the combined axial runout and the combined radial runout of the rotor shaft assembly 100 is optimised.

As an additional step, this stage of manufacturing may further include providing a plurality of rotor shaft caps 300, measuring the runout values of each of the rotor shaft caps, and fitting a selected rotor shaft cap in a selected configuration in order to further optimise the combined runout of the rotor shaft assembly 100.

According to the present example, fitting the rotor shaft cap 300 to the rotor shaft 200 comprises shrink-fitting the disk-shaped body 310 into the annular recess 220. That is to say, cooling the rotor shaft cap 300 results in the rotor shaft cap 300, and particularly the body 310, thermally contracting. Similarly, heating the rotor shaft 200 results in the rotor shaft 200, and thus the annular recess 220, thermally expanding. By either cooling the rotor shaft cap 300 or heating the rotor shaft 200, or both, the rotor shaft cap 300 is fitted into the annular recess 220. Thereby an interference fit may be effected between the rotor shaft cap 300 and the rotor shaft 200.

Figure 12:
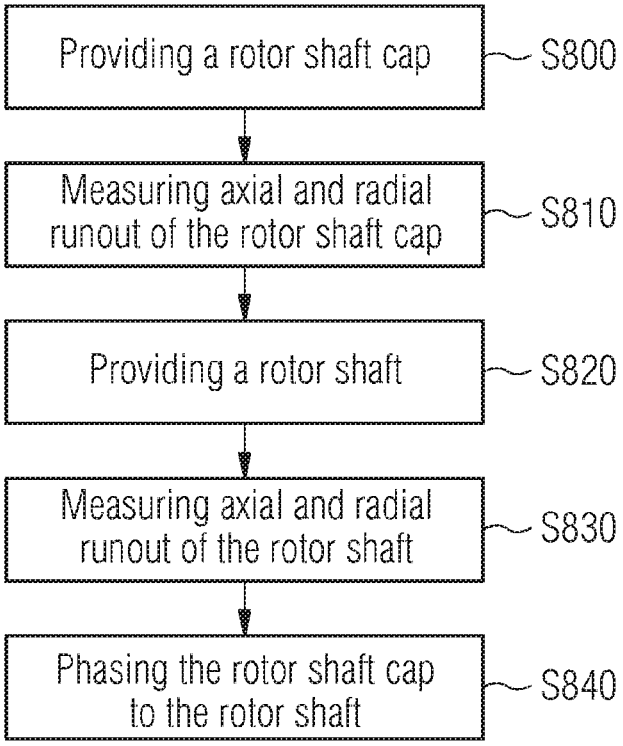
FIG. 12 illustrates a method of fitting the rotor shaft cap to the rotor shaft.

FIG. 12 summarises the steps of fitting the rotor shaft cap 300 to the rotor shaft 200, as outlined earlier. In particular, this comprises the steps of: providing a rotor shaft cap 5800; measuring the axial runout and the radial runout of the rotor shaft cap 5810; providing a rotor shaft 200; measuring the axial runout and the radial runout of the rotor shaft 200; phasing the rotor shaft cap 300 to the rotor shaft 200.

A rotor shaft assembly 100 according to the present disclosure provides for multiple advantages whether those difficulties have been specifically mentioned above or will otherwise be appreciated from the discussion herein. Such advantages include the following.

The rotor shaft assembly 100 is compatible with existing gas turbines, such as the known gas turbine 60, without requiring adaptation of the gas turbine design. That is to say, a known rotor shaft 72 may be replaced with the rotor shaft assembly 100 or a new/refurbished gas turbine may be made according to an existing gas turbine design including the rotor shaft assembly 100.

The rotor shaft cap 300 optionally includes the central aperture 342. The central aperture 342 results in an annular disk-shaped body 310, which may reduce thermal stresses exerted on the rotor shaft cap 300 in response to reaching operating temperatures of a gas turbine.

By providing the second set of apertures 346 in the second annular portion 322 the first annular portion 320 may be provided substantially identical to the corresponding portion of a known rotor shaft. Hence the rotor shaft cap according to the present disclosure may provide for rotational coupling with the mating component which is at least as strong as the rotational coupling provided by the known rotor shaft. In particular, there is no need to remove teeth from the first annular jaw 330 which may negatively affect the rotational coupling.

A rotor shaft assembly 100 coupled to the mating component 600 may possess an improved response to thermal stresses in a gas turbine. In particular, where the rotor shaft cap 300 couples to a portion of the mating component 600 which is made from the same material, stresses resulting from different thermal responses of different materials may be avoided or reduced. Additionally, this may reduce the cost required for achieving this technical benefit as it is not necessary to manufacture the entire rotor shaft 200 from the same material. Particularly where high-performance alloys are used for the mating component 600 this might otherwise result in prohibitive cost.

The rotor shaft assembly 100 has a radial runout and/or axial runout of less than 40 μm. Conventionally about 40 μm are achieved, but it has been found that even runout values of 40 μm can cause vibrations in gas turbines. The rotor shaft assembly 100 may have runout values of less than 35 μm, of less than 30 μm, or of less than 25 μm, or even less than 20 μm.

The rotor shaft assembly 100 may comprises a shrink-fitted rotor shaft cap 300. Shrink-fitting the rotor shaft cap 300 may rotationally couple rotor shaft cap 300 sufficiently that no other structural features are required to ensure enough 'drive', i.e. prevent the cap 300 from slipping during operation.

The rotor shaft cap 300 may be treated for increased durability using processes such as, for example, Nitriding or case-hardening. Some of these processes may not be applicable to a full rotor shaft and hence to be available for a conventional rotor shaft.

According to other examples the disk-shaped body 310 defines no central aperture and possesses no inner radial face. That is to say, the disk-shaped body may not be annular but a solid disk. Accordingly, the second annular portion is not necessarily inwardly along the radial direction 40.

According to other examples, convex teeth may be provided on rotor shaft cap 300, configured to mate with concave teeth on the mating component 600. Here, "convex" and "concave" are used to describe the shape of the teeth as viewed along the axial direction 30, so that a convex tooth has a wide middle portion and narrow ends whereas a concave tooth has a narrow middle portion and wide ends.

According to some examples there is no second annular portion 322 on the disk-shaped body 310. Instead sufficient rotational coupling is attained by hollow dowel pins extending through at least some apertures 344 in the first annular region 320, and pins 500 extending through said hollow dowel pins for axial coupling.

According to some examples, the method of manufacturing the rotor shaft assembly 100 comprises providing the rotor shaft cap 300 with at least some of the apertures 340 after fitting the rotor shaft cap 300 to the rotor shaft 200. In particular, the second set of apertures 346 may be provided or finished after fitting of the rotor shaft cap 300 to optimise coupling.

According to some examples hollow dowel pins are fitted through at least some of the first set of apertures 344 and the first set of holes 244 to improve torque transmission and prevent slippage of the rotor shaft cap 300 within the annular recess 220, i.e. provide rotational coupling. The hollow dowel pins may be provided in addition or as an alternative to the freeze fit and/or the pins 400 fitted through the second set of apertures 346 and the holes 246. The pins 500 may be fitted through the hollow dowel pins to provide axial coupling.

According to the examples discussed above, the first set of apertures 344 and the annular jaw 330 are both provided in the first annular region 320. Thereby the rotor shaft assembly 100 may be fitted to at least some existing gas turbine engines. According to other examples, the annular jaw 330 may be uninterrupted and the first set of apertures 344 may instead be provided radially outwards or radially inwards from the annular jaw 330.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A rotor shaft assembly comprising:
a rotor shaft for a gas turbine, the rotor shaft comprising:
an axial end portion defining an annular recess and,
a rotor shaft cap for a gas turbine, comprising:
a disk-shaped body defining:
a first axial face,
a second axial face, and an outer radial face,
the disk-shaped body comprising:
a first annular jaw provided on the first axial face, the first annular jaw comprising a plurality of teeth projecting from the first axial face; and
a plurality of apertures defined by the disk-shaped body, each aperture of the plurality of apertures extending through the disk-shaped body along an axial direction, wherein the rotor shaft cap is:
received into the annular recess with the first annular jaw extending away from the rotor shaft, and
secured to the rotor shaft by pins through at least some of the plurality of apertures.

2. The rotor shaft cap according to claim 1,
wherein the disk-shaped body further comprises a first annular portion, and wherein the first annular jaw is provided on the first annular portion.

3. The rotor shaft cap according to claim 2,
wherein a first set of apertures of the plurality of apertures is located in the first annular portion, and
at least one tooth of the plurality of teeth is located between a pair of adjacent apertures of the first set of apertures.

4. The rotor shaft cap according to claim 2,
wherein the disk-shaped body comprises a second annular portion, the second annular portion coaxial with the first annular portion and located radially inwards from the first annular portion,
wherein a second set of apertures of the plurality of apertures is located on the second annular portion.

5. The rotor shaft cap according to claim 1, wherein the rotor shaft cap is heat-treated.

6. The rotor shaft cap according to claim 1, wherein the rotor shaft cap is made from a nickel-based superalloy.

7. The rotor shaft cap according to claim 1,
wherein the disk-shaped body has an axial runout or a radial runout of 25 μm or less.

8. The rotor shaft assembly according to claim 1, wherein the rotor shaft cap is shrink-fitted into the annular recess.

9. A gas turbine comprising:
the rotor shaft assembly according to claim 1, and
a mating component comprising a second annular jaw in engagement with the first annular jaw,
wherein the second annular jaw comprises a second set of teeth complementary to a first set of teeth.

10. The gas turbine according to claim 9,
wherein the mating component and the rotor shaft cap are made from a first material, wherein the rotor shaft is made from a second material, and wherein the first material and the second material are different materials.

11. A method of manufacturing a rotor shaft assembly for a gas turbine, the method comprising:

providing a rotor shaft assembly according to claim 1;

measuring axial runout and radial runout of the rotor shaft cap;

providing a rotor shaft defining an annular recess in an axial end portion of the rotor shaft;

measuring the axial runout and the radial runout of the annular recess;

calculating a first combined axial runout and a first combined radial runout of the rotor shaft carrying the rotor shaft cap in the annular recess in a first configuration;

calculating a second combined axial runout and a second combined radial runout of the rotor shaft carrying the rotor shaft cap in the annular recess in a second configuration, wherein the first configuration differs from the second configuration in that the rotor shaft is rotated relative to the rotor shaft cap about the axial direction;

fitting the rotor shaft cap to the rotor shaft in the first configuration or in the second configuration to optimise the combined axial runout and the combined radial runout of the rotor shaft assembly.

12. The method according to claim 11, wherein the fitting of the rotor shaft cap to the rotor shaft comprises shrink-fitting the rotor shaft cap into the annular recess by cooling the rotor shaft cap, heating the rotor shaft or a combination of both, prior to insertion of the rotor shaft cap into the annular recess.

13. The method according to claim 11, wherein the fitting of the rotor shaft cap to the rotor shaft comprises fastening the rotor shaft cap to the rotor shaft by fitting pins through at least some the plurality of apertures extending through the rotor shaft cap and corresponding holes defined by the rotor shaft.

14. The method according to claim 11, wherein the providing the rotor shaft cap comprises manufacturing the rotor shaft cap by:

providing a master having a third annular jaw, the third annular jaw being complementary to the first annular jaw;

mounting the rotor shaft cap onto the master by bringing the first annular jaw and the third annular jaw into engagement, and machining the second axial face and the outer radial face while carrying the rotor shaft cap on the master.

* * * * *